US006607190B1

(12) United States Patent
Guiles et al.

(10) Patent No.: US 6,607,190 B1
(45) Date of Patent: Aug. 19, 2003

(54) APPARATUS FOR PROVIDING GAP CONTROL FOR A HIGH-SPEED CHECK FEEDER

(75) Inventors: Joseph W. Guiles, Prospect, CT (US); Richard F. Stengl, Wolcott, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 10/022,001

(22) Filed: Dec. 14, 2001

(51) Int. Cl.[7] ..... B65H 5/22
(52) U.S. Cl. ..... 271/4.03
(58) Field of Search ..... 271/3.05, 3.06, 271/3.07, 4.02, 4.03, 4.04, 4.05, 4.06, 4.07, 4.08, 4.09, 4.1, 8.1–10.1, 16–10.3, 19–25, 34–271; 221/42, 259, 277, 208, 33; 347/216; 358/498; 399/373, 374; 400/578, 625, 624, 629

(56) References Cited

U.S. PATENT DOCUMENTS 4,445,128 A * 4/1984 Dolan et al. ..... 346/160
6,301,522 B1 * 10/2001 Salazar et al. ..... 700/213
6,499,020 B1 * 12/2002 Dolan et al. ..... 705/406

OTHER PUBLICATIONS

US 6,505,456, 1/2003, Sussmeir (withdrawn)*

* cited by examiner

*Primary Examiner*—Donald P. Walsh
*Assistant Examiner*—Kenneth W Bower
(74) *Attorney, Agent, or Firm*—Michael J. Cummings; Charles R. Malamdra, Jr.; Angelo N. Chaclas

(57) ABSTRACT

A control system for controlling a motor driving a separator roller of a collation-feeder stager assembly in an inserter system including one or more enclosure feeders, the collation-feeder stager assembly including a following roller assembly having a first and a second, following, set of rollers, the control system comprising: an edge sensor, disposed so as to have a line of sight suitable for sensing the arrival, between the first and second set of the following roller assembly, of a leading or trailing edge of a collation, and for providing signals indicating the arrival of the edge; and a controller, responsive to the signals indicating the arrival of the edge, for determining a motion control profile for the motor designed to maintain within a predetermined range a gap between collations based on having the controller decelerate the separator roller upon receiving a leading edge signal from the edge sensor.

18 Claims, 5 Drawing Sheets

APPARATUS FOR PROVIDING GAP CONTROL FOR A HIGH-SPEED CHECK FEEDER

BACKGROUND OF THE INVENTION

1. Technical Field

The invention relates to inserter systems included in mailing machines, for assembling documents into batches or into collations and then for inserting the collations into envelopes. More particularly, the invention is directed to control systems for such inserter systems, and even more particularly to controlling the spacing between documents being handled as they are being fed from a stack of documents.

2. Description of Related Art

Inserter systems capable of generating up to 18,000 mail pieces per hour are well known in the art and are generally used by organizations that produce a large volume of mailings where the content of each mail piece varies. Often, the inputs to an inserter system are computer-generated and printed documents, with each document containing information intended for a particular addressee. The documents may originate from a stack of cut sheets or from a web of forms. It is the function of the inserter system to accept the documents and produce the individual mailings that correspond to each document. To accomplish this, the typical inserter includes a variety of modules for performing different tasks on the documents passing through the inserter. Typical modules are: various web handling modules (slitters, cutters and bursters) for separating the continuous forms into singular or discrete documents, a sheet feeder module for feeding individual cut sheets, an accumulator module for assembling the sheets and/or form documents into a collation, a folder module for folding the collation into a desired configuration (Z-fold, C-fold, half fold), a conveyor/staging module for transporting and queuing the collation, a plurality of enclosure feeder modules for assembling and adding a packet of enclosures to the collation, an insert station module for inserting the collation into an envelope, and a control system to synchronize the operation of the overall inserter system to assure that the collations are properly assembled. Examples of such inserter systems are the 8 Series™ and 9 Series™ inserter systems available from Pitney Bowes, Inc., Stamford, Connecticut.

Typically, information for control of such inserter systems is read from a control document by a scanner associated with the most upstream module in the inserter system. The control document is generally an address bearing document and contains information specific to a particular addressee.

Additionally, each control document contains control information for instructing the downstream modules on how to assemble a particular mail piece. Once scanned, the control information is transmitted to the control system of the inserter system; the control system monitors the processing of the collation through each module. Generally, the control document includes a barcode type control code or other machine-readable markings defining the number of forms or sheets to be accumulated into the collation, the number of enclosures from each of the enclosure feeder modules to be assembled to the collation, and information for other purposes, such as the selection of appropriate postage.

The enclosures assembled to a collation at an enclosure feeder modules are of two types, either generic or specific. The generic enclosures (advertisements, notices, business return envelopes, etc.) are of a general type that are not specifically directed to any particular addressee. Therefore, generic enclosures serve each addressee equally well. On the other hand, specific enclosures (canceled checks, invoice statements, etc.) contain unique information that is directed to a particular addressee. Providing mail pieces with specific enclosures is commonly referred to in the industry as matched mailing; specific enclosures are only meaningful for the appropriate addressee and thus must be matched to each addressee.

An example of a mail piece containing specific enclosures that can be produced by an inserter system is a monthly checking account statement which includes a summary of all account activity (documents—input from the web or sheet feeder modules) and the canceled checks (specific enclosures—input from the enclosure feeder modules). Accordingly, the account summary and the canceled checks associated with the account must be matched together by the inserter system prior to insertion into the envelope.

Therefore, in matched mail applications, a high degree of synchronization must be incorporated into the inserter system for it to function properly. Continuing with the example from above, the canceled checks must be placed into the enclosure feeders in a known order. In similar fashion, the account summaries must be input into the insert system in a corresponding order. In a typical operation, the control document will contain the name, address and account number of a particular addressee. The control code on the control document will inform the inserter system of the number of subsequent following sheets/forms that are necessary to complete the account summary. In response, the inserter system will collect the control document and subsequent sheets/forms in the accumulator module to form a collation. Once completed, the collation advances to the folder module for folding into a desired configuration. After folding, the collation advances to the conveyor/staging module. At this point, the insert system instructs the enclosure feeder modules to feed and collect a packet of enclosures based on information contained in the control code. For example, the insert system may instruct a first enclosure feeder module to feed five enclosures, and a second enclosure feeder module to feed ten enclosures. Next, the document collation is combined with the packet of enclosures to form a new collation, which is then fed downstream for further processing such as inserting it into an envelope. Therefore, it is understood that without a high degree of synchronization, or if something occurs to disturb the synchronization, problems in producing proper matched mailings can occur.

The prior art uses so-called motion control profiles to express, as a function of time, the velocity/speed of an axis of a motor that causes motion of a sheet in a mailing system. A motion control profile consists of a series of segments, each segment having a duration and each corresponding to a state of motion of an axis of a motor ultimately responsible for imparting motion to a sheet or envelope.

In the particular case of a matched mailing in which an inserter provides a customer bank statement along with corresponding canceled checks, a check feeder (enclosure feeder) feeds checks for a collation (of a mail piece) until an account divider page is encountered indicating to the check feeder the end of the checks for the collation. According to the prior art, a check feeder typically operates according to what is referred to as a continuous stream (motion control) profile. Feeding enclosures according to a continuous stream profile has a relatively high risk of jamming and other integrity-compromising events, a risk that is more significant when feeding checks (which are fed width-wise) than when feeding other kinds of enclosures because of the shorter width of checks compared to the widths of other kinds of enclosures.

It would be advantageous to modify the prior art motion control profile for a check feeder (or other, similarly operating insertion module) so as to lessen the risk of jams or other integrity-compromising events.

SUMMARY OF THE INVENTION

Accordingly, a first aspect of the invention provides a control system for controlling the operation of a motor driving a separator roller of a collation-feeder stager assembly of an enclosure feeder module of an inserter system, the inserter system including an input section for producing a sequence of collations, transport means for feeding the sequence of collations in a path of travel, and a chassis section, downstream from the input section, having one or more enclosure feeders, the collation-feeder stager assembly including a following roller assembly having a first and a second, following, set of rollers, the control system comprising: an edge sensor, disposed so as to have a line of sight suitable for sensing the arrival between the first and second set of the following roller assembly of a leading or trailing edge of a collation, and for providing signals indicating the arrival of the leading or trailing edge of the collation; and a controller, responsive to the signals indicating the arrival of the leading or trailing edge of the insertion, for determining a motion control profile for the motor designed to maintain within a predetermined range a gap between collations; wherein the controller decelerates the separator roller upon receiving a signal from the edge sensor indicating the arrival of a leading edge.

In accord with the first aspect of the invention, the motion control profile may include a first higher constant speed segment, followed by a minimum constant speed segment followed by a second higher constant speed segment, wherein the speed of the first higher constant speed segment may be predetermined as may be the speed of the second higher constant speed segment, and further wherein the controller may adjust the speed used for the minimum speed segment and the deceleration of the motor between the first higher speed segment and the minimum speed segment and also the acceleration between the minimum speed segment and the second higher speed segment, thereby lengthening or shortening the three segments and so affecting the gap between successive collations being fed by the enclosure feeder, the lengthening or shortening being calculated by the controller to cause a gap within a predetermined range. Further, the speed of the minimum speed segment may also be pre-determined. In other applications, the separator roller may accelerate the separator roller from the minimum speed segment to the second, higher constant speed segment either upon receiving a signal from the edge sensor indicating the arrival of a trailing edge, or after a predetermined maximum time at minimum speed elapses, whichever occurs earlier.

Also according to a first aspect of the invention, the motor may be a stepper motor.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention. As shown throughout the drawings, like reference numerals designate like or corresponding parts.

BEST MODE FOR CARRYING OUT THE INVENTION

The invention is described below in the context of providing a matched mailing of bank statements and corresponding canceled checks. It should be understood, however, that the invention has more general applicability. As is clear from the description that follows, the invention applies to any mailing in which, according to the prior art, a continuous stream profile is used for feeding enclosures to an inserter to be included in a collation.

Figure 1:
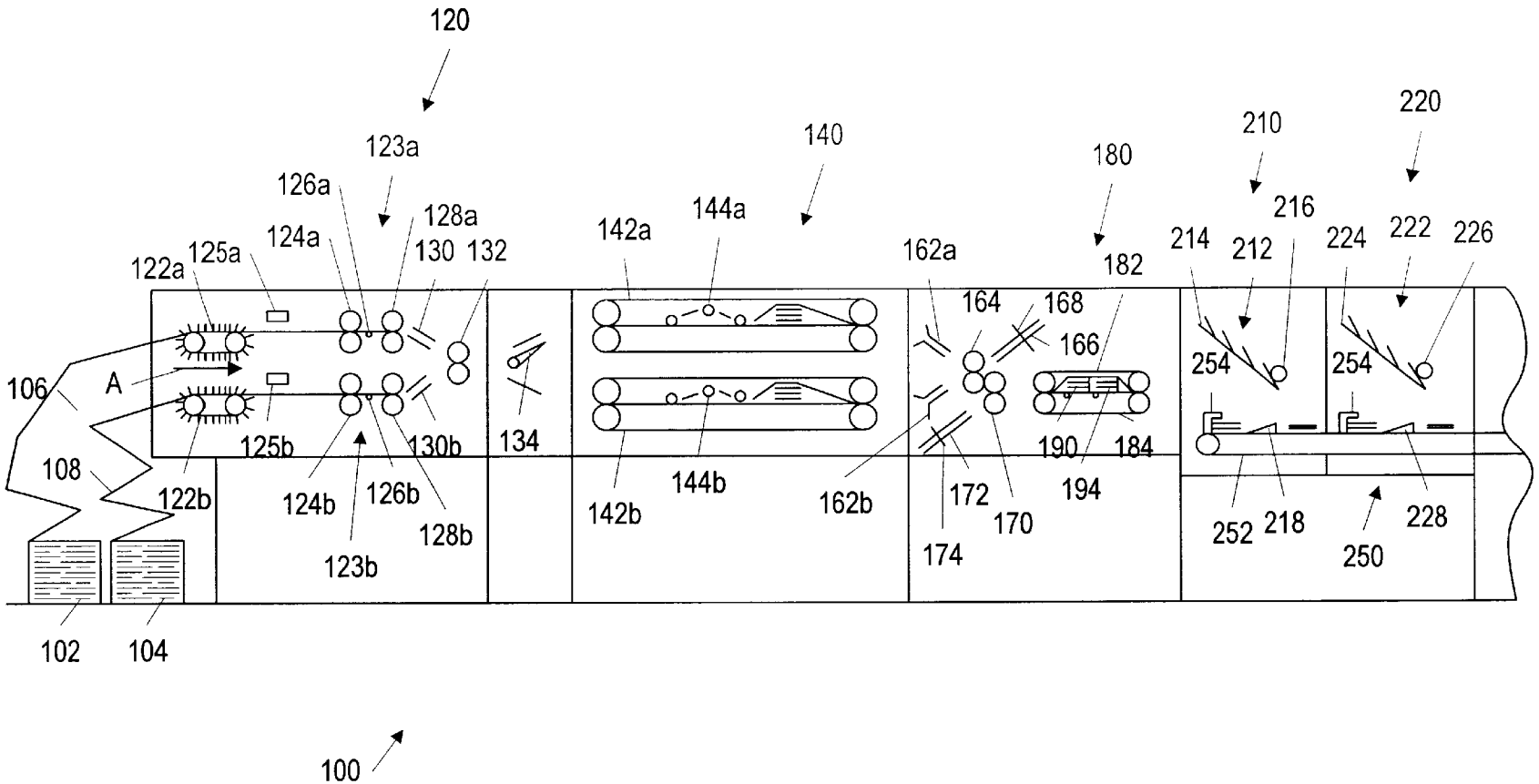
FIG. 1 is a schematic elevational view of an inserter system in which the present invention may be employed.

Referring now to the drawings, and particularly to FIG. 1, there is shown in diagrammatic form a representative inserter system 100 for processing documents fed in a path of travel generally indicated by arrow "A". Typically, inserter systems of the type shown in FIG. 1 include an input section for assembling printed documents into a collation, a chassis section for assembling enclosures (canceled checks in the particular application of the invention being described here) to the collation and stuffing the collation into an envelope, and an output section for further processing of the envelope, such as: sealing, weighing, applying postage, sorting and stacking. The input section of the inserter system 100 includes: a burster module 120, an accumulator module 140, a folder module 160 and a conveyor/staging module 180. The chassis section of the inserter system 100 is only partially shown and includes a first enclosure feeder module 210 and a second enclosure feeder module 220 and other suitable downstream modules for further processing the collation, such as: additional enclosure feeder modules, an envelope feeder module and an insert station module. (For the particular application being described here, one of the enclosure feeders, say the first one, is a check feeder and inserts canceled checks into the collation stream. Others of the enclosure feeders could provide other matched enclosures or could provide generic enclosures.)

The output section of the inserter system 100 is not shown as it has no bearing on the practice of the present invention.

The mechanical construction and arrangement of the various modules that make up the inserter system are well known by those skilled in the art and depends upon the particular requirements of each installation. Since the exact instrumentalities by which each module performs its operations is not necessary for an understanding of the present invention, the discussion of the design details will be will be limited to that which is necessary for an understanding of the present invention. A more detailed description of an inserter system of the type in which the present invention may be employed is provided in U.S. Pat. No. 4,547,856, entitled UNIVERSAL MULTI-STATION DOCUMENT INSERTER, issued Oct. 15, 1985, assigned to the assignee of the present invention and hereby incorporated by reference.

The documents to be processed in the inserter 100 are initially in the form of webs 106 and 108 each containing a plurality of forms (bank statements, all pages of a bank statement for a given customer on one web) joined together at transverse lines of weakening or perforation lines.

Alternatively, the web may be formed by a large roll of printed material that is separated at the input section of the inserter machine. The webs 106 and 108 are normally stored in stacks 102 and 104, respectively, in a fan-fold configuration. The webs 106 and 108 may contain forms of the same or different sizes.

The webs 106 and 108 are first drawn into the burster module 120 which withdraws the webs 106 and 108 from the fan-fold stacks 102 and 104, respectively. The web 106 is advanced by feed assembly 122*a* past a scanner assembly 125*a* toward a bursting assembly 122*a* that separates the forms making up the web 106 into discrete documents or sheets. The feed assembly 122*a*, scanner assembly 125*a* and the bursting assembly 123*a* are all of well known construction. The feed assembly 122*a* includes a tractor drive having a sprocketed belt for engaging the sprocket holes on the lateral edges of the web 106. As the web 106 is fed to the bursting assembly 123*a*, the scanner assembly 125*a* scans a specialized form called a control document (not shown) for a control code (not shown). The control code is typically a barcode and provides instructions and other information to the inserter system 100 for assembling a mail piece corresponding to the control document. (The control document in case of a bank statement mailing is the first page of the bank statement itself.) In current systems, the control code itself might not have the instructions, rather code might refer to a control file in computer memory that includes the information on how the mailpiece is put together. For the purposes of this application, referring to the control code as providing information will also mean the control code acting as a pointer to a control file.

The bursting assembly 123*a* includes a pair of bursting rollers 124*a*, a bursting cone 126*a* and a pair of feeding rollers 128*a*. As is well known in the art, at the instant that a perforation line in the web 106 that separates two adjacent forms is over the burst cone 126*a*, the bursting rollers 124*a* are momentarily decelerated while the feeding rollers 128*a* continue to feed at a constant rate. This action produces a momentary tension on the web 106 and, with the assistance of the burst cone 126*a*, generates sufficient force to snap or burst the lead form of the web 106 from the upstream adjacent form. The web 108 is handled in analogous fashion by feed assembly 122*b*, scanner assembly 124*b* and bursting assembly 123*b* which includes a pair of bursting rollers 124*b*, a burst cone 126*b* and a pair of feeding rollers 128*b*.

The discrete documents from the webs 106 and 108 are then fed between suitable guides 130*a* and 130*b* that direct them to a single pair of feed rollers 132 and past a movable deflector 134 to the accumulator module 140. The accumulator module 140 includes an upper and lower transport assembly 142*a* and 142*b*, respectively, for stacking a plurality of documents on top of each other. The deflector 134 actuates between two positions so as to direct the documents separated from the webs 106 and 108 to either the upper transport assembly 142*a* or lower transport assembly 14*b*. The upper transport assembly 142*a* includes an adjustable stacking device 144*a* while the lower transport assembly 142*b* includes an adjustable stacking device 14*b*.

In operation, documents from the webs 106 and 108 are feed in alternating fashion between the upper transport assembly 142*a* and the lower transport assembly 142*b*. For example, to assemble a first collation, a first control document from web 106 is scanned and provides the insert system 100 with information about the number of following forms from web 106 that belong with the first control document, in this example three forms. Thus, with the deflector 134 positioned as shown, the first control document and the following three forms are sequentially fed, burst and directed into upper transport assembly 142*a* to assemble the first collation containing four documents (the control document and the following three forms). Next, to assemble a second collation, the web 108, containing a second control document having a barcode thereon, is advanced by the burster assembly 120. Again, the barcode provides the insert system 100 with information of the number of following forms from web 108 that belong with the second control document, in this example two forms. Thus, the deflector 134 must be repositioned so that after the second control document and the following two forms are sequentially fed and burst, they are directed into lower transport assembly 142*b* to assemble the second collation containing three documents (the control document and the following two forms). In this manner, collations are sequentially and alternately assembled in the upper and lower transport assemblies 142*a* and 142*b* so as to increase overall system throughput.

Once a collation has been assembled in the accumulator module 140, it is fed into the folder module 160 which is capable of accepting collations from either of the upper or lower transport assemblies 142*a* and 142*b* from guides 162*a* and 162*b*, respectively. The folder module 160 includes a first pair of folding rollers 164, a first buckle chute 166 having an adjustable end stop 168, a second pair of folding rollers 170 and a second buckle chute 172 having an adjustable end stop 174. The end stops 172 and 174 are repositionable along the length of the buckle chutes 166 and 172, respectively, depending upon the desired fold configuration. The collations are fed into the first buckle chute 166 until the lead edge of the collation abuts the end stop 168. When this happens, a buckle forms in the collation between the lower roller of pair 164 and the upper roller of pair 170. As the collation continues to feed, the buckle continues to form and is forced between the nip of these rollers. These rollers crease the collation and, as a result, the crease now becomes the new leading edge of the partially folded collation. This lead edge is next directed to the second buckle chute 172 until the lead edge abuts an end stop 174 and a new buckle forms next to the nip between the second pair of folding rollers 170. When this happens, another crease is formed as the collation is forced between the nip of these rollers. Thus, the collation is folded twice. However, those skilled in the art will recognized that the setup of the folder module 160 may be reconfigured to achieve different fold configurations by adjusting the position of the end stops 168 and 174. Furthermore, the buckle shoots 166 and 172 may be bypassed altogether by placing diverters in the feed path of the collation.

As the collation exits the second pair of folding rollers 170 of the folding module 160, the collation is fed into the conveyor/staging module 180. The conveyor/staging module 180 includes an upper O-ring transport assembly 182, a lower O-ring transport assembly 184, and a plurality of solenoid actuated stop assemblies 190 and 194. Each stop assembly 190 and 194 is selectively and independently operable to both stop and allow feeding of the collation. To stop feeding the collation, each stop assembly 190 and 194 includes a collation obstructing surface that is positionable in the feed path of the collation to prevent further downstream travel as the O-rings slip past the collation. On the other hand, to allow feeding the collation, the obstructing surface is repositioned out of the feed path so that the O-rings carry the collation downstream.

As the collation is fed from the conveyor/staging module 180, the collation drops onto the feed deck of the chassis section of the inserter system 100. The first enclosure feeder module 210 includes a stack 212 of enclosures loaded into a feed tray 214 and an enclosure feed assembly 216 for delivering the enclosures in seriatim onto the feed deck and into the path of travel. Additionally, the feeder module 210 includes a ramp 218 which will be discussed in more detail below. Similarly, the second enclosure feeder module 210 includes a ramp 228, a stack 222 of enclosures loaded into a feed tray 224 and an enclosure feed assembly 226 for delivering the enclosures in seriatim onto the feed deck and into the path of travel. Thus, the second enclosure feeder module 220 is substantially similar to the first enclosure feeder module 210. However, in matched mail and other applications, the enclosures in stack 212 and stack 222 will not be identical. Those skilled in the art will recognize that any number of enclosure feeder modules can be incorporated into the chassis section. Furthermore, some of the enclosure feeder modules may contain matched or specific enclosures while other enclosure feeder modules may contain generic enclosures.

Running the length of the enclosure feeder modules 210 and 220 is a transport assembly 250 including an endless chain 252 having a plurality of pusher fingers 254 attached thereon. The endless chain 252 is located below the feed deck while the pusher fingers 254 rise and fall below the feed deck as the chain 252 advances. The pusher fingers 254 work in cooperation with the ramps 218 and 228 to assemble the collation to the enclosures so as to form a new collation. The enclosure feed assemblies 216 and 226 deliver the appropriate number of enclosures onto the feed deck of the chassis section downstream from the ramps 218 and 228, respectively. As the pusher fingers 254 advance, the collation is pushed over ramp 218 landing on top of the waiting enclosures that were fed down from enclosure feed assembly 216. Then, this new collation is fed downstream together by the pusher fingers 254 toward the second enclosure feeder module 220 where the above sequence of events are repeated. The pusher fingers 254 push the collation, containing both folded documents and enclosures, from the first enclosure feeder module 210 up and over ramp 228 landing on top of the waiting enclosures that were fed down from enclosure feed assembly 226. Then, this new collation is fed downstream by the pusher fingers 254 for further processing.

After passing by the enclosure feeder modules 210 and 220, the collation will proceed to further downstream modules, such as: more enclosure feeder modules and an insert station module where the final collation is stuffed into an envelope. Then, the envelope is fed into the output section of the inserter system 100. Those skilled in the art will recognized that it is possible to have further downstream modules and various combinations for these modules. However, the exact arrangement of these modules has no bearing on the practice of the present invention.

Figure 2:
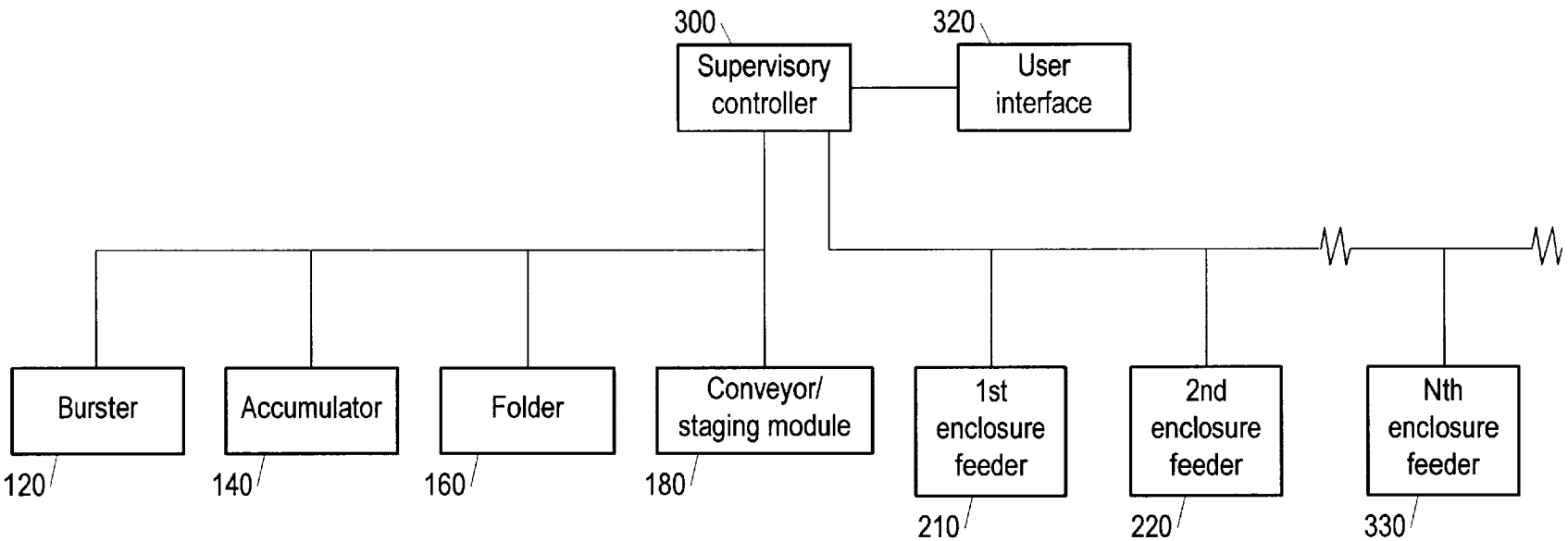
FIG. 2 is a block diagram which represents the communication network of the inserter system of FIG. 1.
Figure 3:
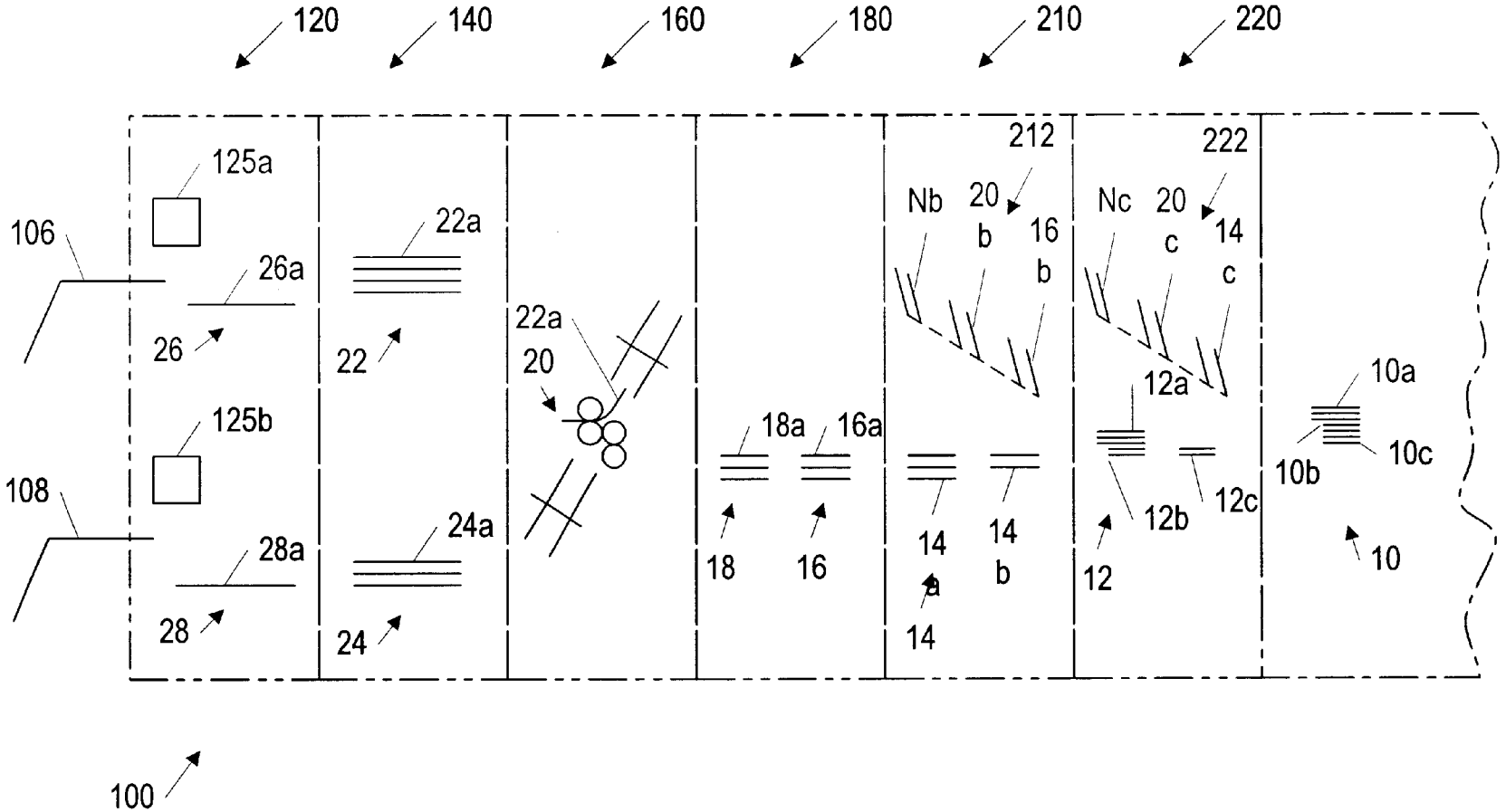
FIG. 3 is a diagrammatic view of the inserter system of FIG. 1 having a plurality of collations in various stages of completion.

From the above description, it should be apparent that the operations of the various modules of the inserter system 100 require a high degree of coordination so as to correctly produce matched mailings. Referring to FIG. 2, a block diagram is shown which represents the communication network of the inserter system 100. A supervisory controller 300 is in communication with a user interface 320, the input section (burster, accumulator, folder, conveyor/staging), and the chassis section (first enclosure feeder 210, second enclosure feeder 220, Nth enclosure feeder 330, etc.) of the inserter system 100. The supervisory controller 300 represents both a high level machine control system that is independent of the exact configuration of the inserter system 100 and a low level machine control system that is dependent on the exact configuration of the inserter system 100. The supervisory controller 300 includes suitably designed memory, microprocessors and software programs to carry out its functions. The supervisory controller 300 commands and coordinates the interactions among the various modules by monitoring the progress of the collations through the inserter system 100 and by providing instructions to the various modules as needed. Additionally, the supervisory controller 300 receives inputs from an operator through the user interface 320. These inputs may be of varying types, but are typically focused on job setup information for the inserter system 100.

The supervisory controller 300 is a hybrid hardware and software system the exact implementation of which is a matter of design choice. A more detailed description of the architecture of the supervisory controller 300 is provided in:

U.S. Pat. No. 4,527,790, entitled APPARATUS AND METHOD FOR SEPARATING MULTIPLE WEBS OF DOCUMENTS HAVING THE CAPABILITY FOR ORDERLY SHUT-DOWN AND RE-START OF OPERATION, issued Jul. 9, 1985; and U.S. Pat. No. 4,527,468, entitled APPARATUS FOR SEPARATING MULTIPLE WEBS OF DOCUMENTS INTO DISCRETE DOCUMENTS AND FORMING THE DISCRETE DOCUMENTS INTO PREDETERMINED BATCHES, issued Jul. 9, 1985, both of which are assigned to the assignee of the present invention and hereby incorporated by reference. Additionally, U.S. patent application Ser. No. 036,134, entitled SYSTEM AND METHOD FOR TWO LEVEL REAL-TIME CONTROL OF AN INSERTING MACHINE issued on Sep. 5, 1995 as U.S. Pat. No. 5,448,490 and U.S. patent application Ser. No. 232,542, entitled OPEN STATION ARCHITECTURE FOR AN INSERTER SYSTEM, issued on Feb. 11, 1997 as U.S. Pat. No. 5,603,059 both of which are assigned to the assignee of the present invention provide further detailed discussion of the supervisory controller 300 and are also hereby incorporated by reference.

According to the prior art, a check feeder typically operates according to what is referred to as a continuous stream (motion control) profile, and feeding enclosures, especially checks or other narrow insertions (relative to the direction of travel of the insertions through the insertion), according to a continuous stream profile has a relatively high risk of jamming and other integrity-compromising events. The present invention therefore provides a motion control profile for a check feeder that triggers off the trailing edge of the checks being fed to a collation. By triggering off the trailing edge of the checks, the motion control profile of the invention maintains a safe gap between checks. According to the motion control profile of the invention, when the trailing edge of a check is sensed, the check feeder stepper motor is decelerated so as to delay feeding the next check until a proper gap is provided. (What constitutes a proper gap depends on the operating parameters of the inserter and check feeder.)

Figure 4:
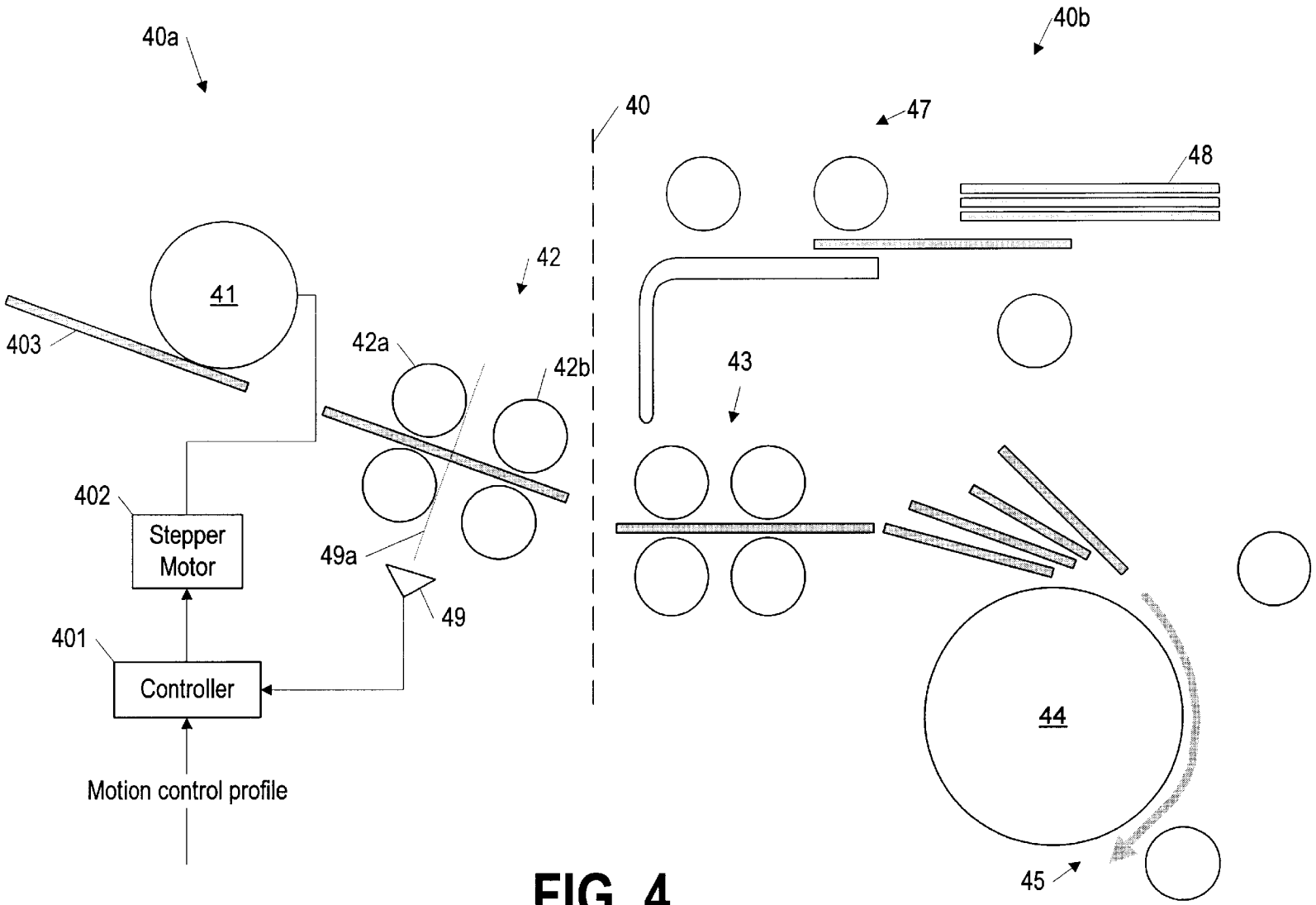
FIG. 4 is a schematic representation of the invention.

Referring now to FIG. 4, a plan view of an enclosure feeder module 210 (FIG. 1) for feeding checks is shown as including two sub-assemblies separated by a dashed vertical line 40. The sub-assembly to the left of the dashed vertical line is a check-feeder stager assembly 40*a*, and the sub-assembly to the right is a check feeder header assembly 40*b* (part of what is called an enclosure accumulator). The check feeder stager assembly provides checks to the check feeder header assembly with a gap separation intended to be such as to avoid jams or other integrity-compromising events. The check feeder header assembly provides the checks to the collation stream (where the checks are merged with their associated bank statement collations), and also diverts checks from the stream as necessary. The check feeder header 40*b* will not be described in detail here, since the invention resides in the check feeder stager 40*a*, but the check feeder header 40*b* includes a transport belt assembly 43 for receiving the checks provided by the check feeder stager (and not to be diverted from the collation stream) and an indexing drum 44 for providing the checks issuing from the transport belt assembly to the collation stream. The check header assembly 40*b* also includes a diverting and stacking assembly 47 for diverting checks from the collation stream.

The check feeder stager assembly 40*a*, where the invention resides, includes a separator roller 41 driven by a stepper motor 402 under the control of a controller 401 directing the operation of the stepper motor according to a motion control profile provided as input to the controller. The separator roller 41 grasps checks 403 (or other insertions) and causes the checks to be provided to a feed roller assembly 42, including an upper first roller 42*a*, at a velocity and frequency based on the motion of the stepper motor. Feed roller assembly 42 feeds checks at a constant velocity upon receiving them from the separator roller 41. In the preferred embodiment, the feed roller assembly feeds checks at a speed of 110 inches/sec.

As the checks are being fed, the controller 401 receives signals from a photocell 49 having a line of sight 49*a*; the signals indicate the arrival of the leading and trailing edge of checks being fed through the feed roller assembly 42. (Besides a photocell, any other type of sensor could be used, as long as the sensor is able to sense the arrival of the trailing edge of an insertion.)

The controller 401 then commands the stepper motor 402 so as to create an adequate gap between the checks, based on the signals it receives from the photocell 49. Thus, the motion control profile of the invention is based on the actual position of a document being processed and so is based on signals received from a sensor. In addition, the motion control profile can be independent of the motion of the axis of any other motor (at least not expressly, but still impliedly if the checks are fed to the check feeder stager by some preprocessor under the action of a pre-processor motor, and the motion control profile for the stepper motor 402, although not expressly tied to the motion of such a pre-processor motor, would nevertheless depend in fact on the motion control profile of the pre-processor motor). More specifically, it is the acceleration and deceleration of the stepper motor 402 (and in turn the separator roller 41) that are regulated by the controller 401 so as to control the gap between the checks to within a range pre-determined to be such as to avoid jamming and other integrity-compromising events.

Figure 5:
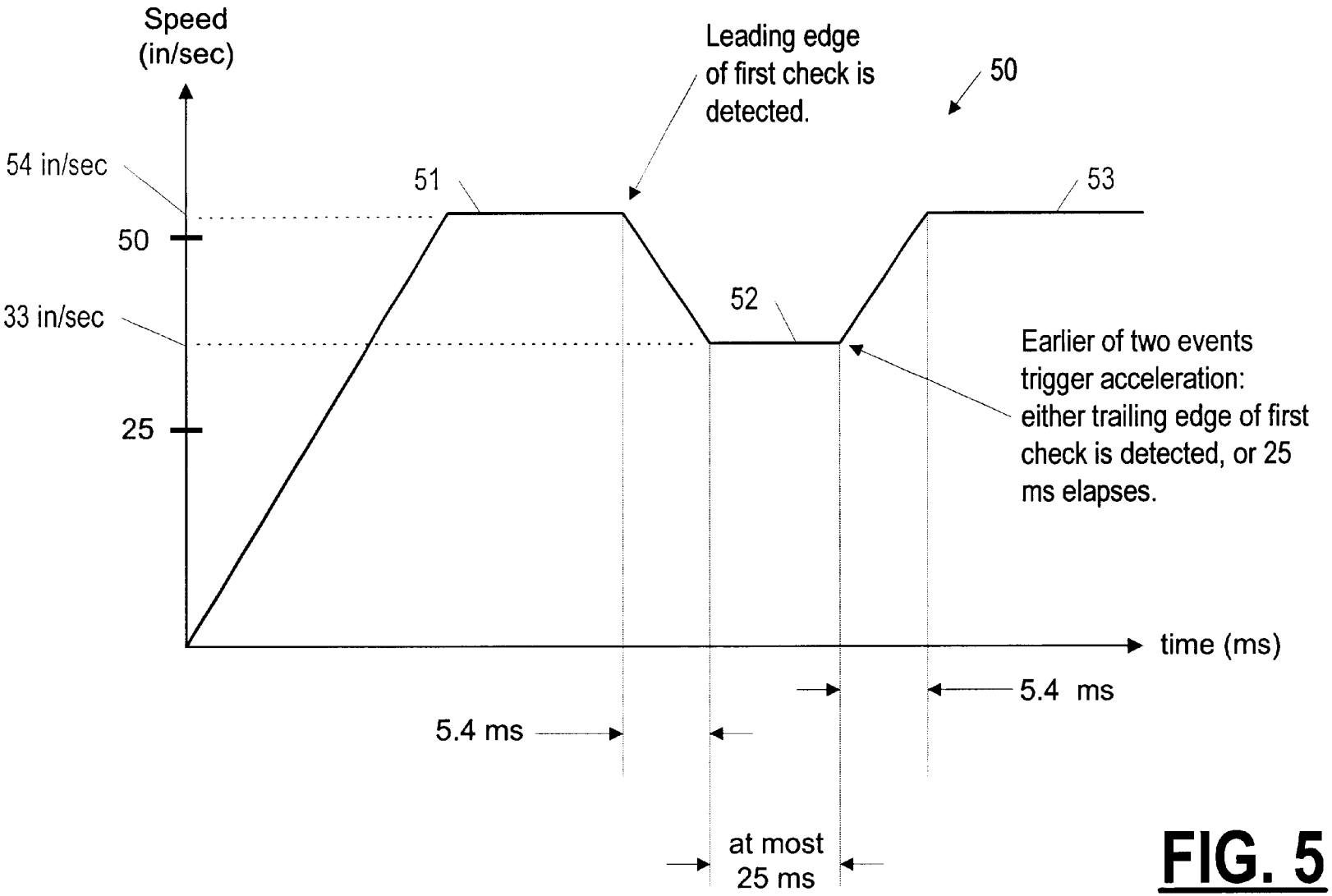
FIG. 5 is a sample motion control profile for a stepper motor of a check feeder sub-assembly determined according to the invention.

Referring now to FIG. 5, an exemplary motion control profile 50 for the speed of documents fed by the separator roller 41 is shown. The motion profile 50 includes a peak speed segment 51 continued for approximately 18 ms followed by a deceleration to a minimum speed segment 52, the deceleration occurring over a time of 5.4 ms, followed by another acceleration back to a final segment 53 at the original maximum speed, the final acceleration occurring again over a time of approximately 5.4 ms. The minimum speed segment 52 shows that the stepper motor 402 drives the separator roller 41 at a minimum speed of approximately 33 inches/sec for a period of approximately 25 ms. The slowing of the separator roller for such a time interval maintains an adequate separation of checks (in the particular inserter used in the test). As explained below, as a second of two consecutive checks moves through the separator roller, the duration of the second constant speed segment 52 depends on the earlier of two events. The deceleration to the lower constant speed of the minimum speed segment 52 begins when the leading edge of the first check is sensed (by the optical sensor 49 along the line of sight 49*a*). Then, the acceleration to the constant speed of the final segment 53 is triggered by either a maximum predetermined time (of 25 ms in the preferred embodiment) elapsing before the trailing edge of the first check is detected (along line of sight 49*a*), or the trailing edge of the first check is detected, whichever occurs first.

It should be understood that although FIG. 5 shows a stepper motor motion control profile having two constant speed segments at the same maximum speed (and one intervening lower constant speed segment), it is also possible for a motion control profile according to the invention to have a first constant higher speed segment, followed by a deceleration, followed by a minimum constant speed segment, followed by an acceleration, and then finally followed by a second constant higher speed segment at a speed not necessarily the same as for the first constant higher speed segment.

Referring back to FIG. 4, in the prior art, the separator roller 41 was operated at a constant speed feeding checks from a stack. By operating at this constant speed the checks have little initial separation between them. As checks passed from separator roller 41, they were grabbed by the feed rollers 42, which operated at a higher speed than the separator roller 41. In this way, a space was generated between subsequent checks, as a preceding check was grabbed away at a higher speed. However, the spacing was still not as great or as reliable as desired.

To increase the spacing one might consider speeding up the feed rollers 42 or slowing down the separator roller 41. However, the resulting speed differential between the separator 41 and the feed rollers 42 could itself be a cause of jamming or damage to checks. Running the separator roller 41 too slowly could also slow down the overall speed of the machine.

As described above, the invention resolves the gap problem by varying the speed of the separator roller using a motion profile as in FIG. 5. In the preferred embodiment the object is to achieve an approximate one-inch gap between checks. As mentioned previously, in the preferred embodiment, the feeder rollers 42 operate at a constant speed of 110 inches/sec. The gap control is achieved by varying the speed of separator 41. The faster the average speed of separator roller 41 relative to the feeder rollers 42, the shorter the gap between subsequent may become, and under some conditions the gap between checks may fall below the preferred one inch distance.

Again referring to FIG. 4, the center-to-center distance between the separator roller 41 (of the stager assembly 40*a*) and the following first upper roller feed 4*a* is 1.98", with the feed rollers 42 each having a 1" radius. In addition, the center-to-center distance between the first following upper feed roller 42*a* and the second following upper feed roller 42*b* is 2.387". The gap between a first check and a next check is adjusted by sensing the position of the first check, and adjusting the speed of separator roller 41 as the separator roller 41 moves the next check.

Referring again to the motion profile in FIG. 5, in the preferred embodiment, the separator roller 41 moves checks at a high speed of 54 in/sec corresponding to the first constant speed segment 51. When the leading edge of the first check in the feed rollers 42 is sensed by the optical sensor 49 (along the line of sight 49*a*), the separator roller 41 executes a predetermined deceleration to the lower speed of 33 in/sec, corresponding to the second constant speed segment 52. During this slower interval, the first check is carried away from the subsequent check by the feed rollers 42 at the nominal constant speed of 110 in/sec.

The earlier of two events then triggers the separator roller 41 to accelerate back to its original higher speed corresponding to the third constant speed segment 53. (In other than the preferred embodiment, the third constant speed could be different from the first constant speed, as noted above.) The first triggering event is when the optical sensor 49 detects the trailing edge of the first check. The second triggering event is when a predetermined maximum amount of time passes. For example in one of the exemplary embodiments, the maximum time for the deceleration period is 25 ms.

Based on the relative distances between the rollers, the size of the checks, and the desired operating speeds, the inventors have determined that the motion control profiles shown in FIG. 5 provide an improved spacing between fed checks.

In another embodiment, the motion control profile of the separator roller 41 includes a first constant speed segment of 70 in/sec, followed by a deceleration to a minimum constant speed segment of 41 in/sec, followed by an acceleration to a final constant speed segment of again 70 in/sec. In this embodiment, the maximum duration of the second, minimum constant speed segment is 5 ms.

In both the motion control profile of the preferred embodiment and the alternative motion control profile, the speeds of the initial and final constant speed segments are predetermined machine speeds. The respective shapes of the motion profiles are aimed at achieving a gap of approximately one inch between successive checks. Thus, the motion control profile used in any particular application depends on constraints associated with speeds of the interfacing equipment, and the values indicated for the speeds of the constant speed segments in the preferred and alternative embodiments are merely exemplary.

It is obvious from the above description that the motion of the stepper control motor 402 can be varied not only with respect to acceleration and deceleration between the fixed speed segments (the two higher speed segments and the intervening lower speed segment), but also in respect to the speeds used for the constant speed segments. Typically, however, the speeds for the two higher constant speed segments are constrained by how the separator roller 41 interfaces with or couples to other equipment and it is only therefore the lower speed and the acceleration and deceleration that can be adjusted to provide a suitable gap between successive checks (or other enclosures). Moreover, for the sake of definiteness, the invention preferably fixes the lower speed to some predetermined value, and then it is only the acceleration and deceleration that are adjusted.

It is to be understood that the above-described arrangements are only illustrative of the application of the principles of the present invention. In particular, it should be understood that the invention is in no way restricted to feeding checks to a high speed inserter, even though checks, with their narrow width, motivated the invention. The invention is of general use, in any enclosure feeder, for feeding any kinds of enclosures to a high speed inserter. Moreover, the invention is not restricted to the motion the sample motion control profile indicated in FIG. 5, which is offered merely as representative of the motion control profiles determined and used by a controller for one particular high speed inserter in the case of feeding checks into the inserter. Numerous modifications and alternative arrangements may be devised by those skilled in the art without departing from the spirit and scope of the present invention, and the appended claims are intended to cover such modifications and arrangements.

What is claimed is:

1. A control system for controlling operation of a separator roller of a document feeder stager assembly, the separator roller feeding documents to a feed roller assembly having a first and a second set of rollers, the feed roller assembly having a constant document transport speed during operation, the constant document transport speed always being faster than a rate of document feeding from the separator roller, the control system comprising:

a) an edge sensor, disposed so as to have a line of sight between the first and second set of rollers, the edge sensor sensing an arrival of a leading or trailing edge of a document, the edge sensor providing signals indicating the arrival of the leading or trailing edge of the document; and b) a controller, responsive to the edge sensor signals, controlling feeding of documents by the separator roller utilizing a predetermined motion control profile whereby the controller decelerates the separator roller from an original speed to a lower speed upon receiving the signal from the edge sensor indicating the arrival of a leading edge, the separator operating at the lower speed for a low speed interval, and whereby the controller subsequently accelerates the separator roller back to the original speed.

2. The control system of claim 1 wherein the controller controls the low speed interval to be a predetermined maximum length of time.

3. The control system of claim 1 wherein the controller ends the low speed interval and accelerates the separator roller back to the original speed when a trailing edge is sensed by the edge sensor.

4. The control system of claim 1 wherein the controller ends the low speed interval and accelerates the separator roller back to the original speed upon the first of an expiration of a predetermined maximum length of time, or the detection of a trailing edge by the edge sensor.

5. The control system of claim 4 wherein the lower speed is predetermined.

6. The control system of claim 5 wherein the deceleration from the original speed to the lower speed and the acceleration from the lower speed to the original speed is controlled by the controller at predetermined rates during predetermined deceleration and acceleration intervals.

7. The control system of claim 6 wherein the separator roller is approximately two inches from the first set of feeder rollers, and wherein the feeder roller assembly operates at 110 in/sec, the original speed is 54 in/sec, the lower speed is 33 in/sec, the predetermined maximum length for the low speed interval is 25 ms, and the predetermined deceleration and acceleration intervals are 5.4 ms.

8. The control system of claim 6 wherein the separator roller is approximately two inches from the first set of feeder rollers, and wherein the feeder roller assembly operates at 110 in/sec, the original speed is 70 in/sec, the lower speed is 41 in/sec, the predetermined maximum length for the low speed interval is 5 ms, and the predetermined deceleration and acceleration intervals are 7.5 ms.

9. The control system of claim 6 wherein the document feeder stager assembly is a check feeder assembly and the documents are checks.

10. A method for controlling operation of a separator roller of a document feeder stager assembly, the separator roller feeding documents to a feed roller assembly having a first and a second set of rollers, the feed roller assembly having a constant document transport speed during operation, the constant document transport speed always being faster than a rate of document feeding from the separator roller, the method for controlling comprising:

sensing an arrival of a leading or trailing edge of a document between the first and second set of rollers; and decelerating the separator roller from an original speed to a lower speed upon sensing the arrival of a leading edge between the first and second set of rollers, operating the separator roller at the lower speed for a low speed interval, and accelerating the separator roller back to the original speed.

11. The method of claim 10 further comprising controlling the low speed interval to be predetermined maximum length of time.

12. The method of claim 10 further comprising ending the low speed interval and accelerating the separator roller back to the original speed upon the sensing of a trailing edge.

13. The method of claim 10 further comprising ending the low speed interval and accelerating the separator roller back to the original speed upon the first of an expiration of a predetermined maximum length of time, or the sensing of a trailing edge.

14. The method of claim 13 wherein the lower speed is predetermined.

15. The method of claim 14 wherein the steps of decelerating from the original speed to the lower speed and accelerating from the lower speed to the original speed is controlled to be at predetermined rates during predetermined deceleration and acceleration intervals.

16. The method of claim 15 wherein the separator roller is approximately two inches from the first set of feeder rollers, and wherein the feeder roller assembly operates at 110 in/sec, the original speed is 54 in/sec, the lower speed is 33 in/sec, the predetermined maximum length for the low speed interval is 25 ms, and the predetermined deceleration and acceleration intervals are 5.4 ms.

17. The method of claim 15 wherein the separator roller is approximately two inches from the first set of feeder rollers, and wherein the feeder roller assembly operates at 110 in/sec, the original speed is 70 in/sec, the lower speed is 41 in/sec, the predetermined maximum length for the low speed interval is 5 ms, and the predetermined deceleration and acceleration intervals are 7.5 ms.

18. The method of claim 15 wherein the document feeder stager assembly is a check feeder assembly and the method further comprises feeding checks as the documents from the separator roller.

* * * * *